United States Patent [19]

Hyatt

[11] 4,291,670

[45] Sep. 29, 1981

[54] GAS FIRED FIREPLACE INSERT WITH HEAT EXTRACTOR

[76] Inventors: Everett C. Hyatt, 3157 Peg Leg Mine Rd., Jamul, Calif. 92035

[21] Appl. No.: 166,765

[22] Filed: Jul. 8, 1980

[51] Int. Cl.[3] ..... F24B 7/00;

[52] U.S. Cl. ..... 126/121; 126/129; 126/131;

[58] Field of Search ..... 126/121, 129, 127, 131, 126/123, 164, 120; 431/328;

[56] References Cited

U.S. PATENT DOCUMENTS

| | | | |
|---|---|---|---|
| 574,271 | 12/1896 | Roberts | 126/129 |
| 2,080,323 | 5/1937 | Limoni | 126/121 |
| 3,385,651 | 5/1968 | Rasmussen et al. | 126/127 |
| 3,938,496 | 2/1976 | Kampf et al. | 126/121 |
| 4,129,113 | 12/1978 | Bergstrom | 126/121 |
| 4,159,802 | 7/1979 | Ficker et al. . | |

FOREIGN PATENT DOCUMENTS

| | | | |
|---|---|---|---|
| 452774 | 8/1936 | United Kingdom | 126/121 |

OTHER PUBLICATIONS

"Thermograte" brochure, Thermograte, Inc. 2785 N. Fairview Ave., St. Paul, MN 55113.

*Primary Examiner*—Samuel Scott
*Assistant Examiner*—Lee E. Barrett
*Attorney, Agent, or Firm*—Brown & Martin

[57] ABSTRACT

A combination glass door fireplace closure and heat exchanger which can be inserted into the cavity of a gas fired fireplace to permit more efficient and economical operation thereof. The insert includes a plurality of substantially parallel C-shaped exchanger tubes. The lower and upper ends of the tube are coupled to a glass door fireplace closure which is adapted for sealing the frontal opening of the fireplace cavity. A substantially C-shaped heat exchanger duct surrounds the tubes and the lower and upper ends thereof are coupled to the glass door fireplace closure. A gas pipe nozzle is mounted beneath the tubes above the heat exchanger duct and is covered by a quantity of sand supported by a tray. The nozzle pipe is coupled to a gas supply pipe extending from the side of the fireplace. Gas discharged from the pipe diffuses through the sand to produce uniform burning when mixed with air drawn through a combustion air inlet in the glass door fireplace closure. A fan blows air through the heat exchanger tubes. Air flows by convection through the exchanger duct. A first manifold structure permits air to be separately drawn into the heat exchanger tubes, the heat exchanger duct, and into the combustion area through the fireplace closure. A second manifold structure at the top of the fireplace closure couples the upper end of the heat exchanger tubes and the heat exchanger duct so that warm air is expelled therefrom through common air outlets in the fireplace closure.

3 Claims, 6 Drawing Figures

GAS FIRED FIREPLACE INSERT WITH HEAT EXTRACTOR

BACKGROUND OF THE INVENTION

The present invention relates to apparatus and methods for improving the heating efficiency of fireplaces, and more particularly, to a heat extractor insert for a decorative, non-wood burning fireplace whose flame is normally generated by combustible natural gas supplied thereto from utilities.

The heating function of fireplaces has been relatively unimportant in modern homes because of the widespread use of more effective alternate heating sources such as centrally located forced air furnace systems. Recently, excessive demand on sources of energy has resulted in continually escalating fuel costs. Increased attention has been focused upon improving the heating efficiency of fireplaces in terms of heat output versus fuel consumption.

Heat output from conventional fireplaces exists in three different forms: (1) conduction; (2) convection; and (3) radiation. In a typical openfront fireplace equipped with a grate substantially all of the heating effect results from radiant heat. Very little useful heat is gained by conduction or convection. In many cases, warm room air is actually drawn into the fireplace and exhausted up the chimney due to the rather substantial draft created by the fire. Since this creates a slight negative pressure within the room, cold air from outside the dwelling is drawn into the house through cracks and other inlets and this often results in a net loss of warm air from the room. While individuals sitting directly in front of the fireplace may be warmed by the radiant heat from a hot fire burning therein, such radiant heat does not warm the air as it travels therethrough. Thus, as soon as individuals remove themselves a sufficient distance from the fire, they sacrifice any warming benefits derived therefrom.

Another drawback of conventional fireplaces is that the wood is combusted too rapidly. Not only does this create a substantial draft up the chimney which draws warm air out of the room, but it also results in the expense of burning large quantities of wood with little or no effective heat output.

In an effort to reduce the loss of warm room air through open-front fireplaces, glass door closures have been used. Some of these have been equipped with adjustable dampers to permit the rate of combustion of the wood to be controlled.

In the interest of improving the heating efficiency of open-front fireplaces, tubular fireplace grates and other heat exchanger conduit structures for fireplaces have been developed. When the conduits are heated by the flames, cold air can be drawn into the tubes by convection and after being warmed, the air is expelled back into the room. Some of these heat exchangers have been equipped with blowers to increase their heat exchange efficiency. These heat exchangers can substantially increase the room air temperature.

Recently the desirable features of a glass door closure and a heat exchanger conduit structure have been combined into a single decorative fireplace insert. Products of this type reduce room air losses through the fireplace, while increasing convective heat output through the heat exchanger conduits and from the face of the glass door closure. They also permit wood to be combused at a slow controlled rate so that the maximum BTU value of the fuel can be extracted in an efficient manner. One such combination glass door closure and heat exchanger fireplace insert is disclosed in U.S. Pat. No. 4,129,113 of Bergstrom, and is sold under the trademark "THERMOGRATE". That insert includes a plurality of generally parallel C-shaped heat exchanger tubes having open lower and upper ends which draw and expel air, respectively, through a glass door fireplace closure. A blower forces air through a special manifold structure and through the tubes to maximize transfer of heat from burning logs surrounded by the tubes. In one commercial form of this insert, a sheet metal panel is mounted behind the tubes for redirecting heat normally lost to the rear of the fire chamber back onto the heat transfer surfaces of the heat exchanger tubes.

Heretofore, combination glass door closures and heat exchanger conduit inserts have generally been adapted for burning wood, although in some instances coal and other articulate fuels made of wood chips held together with a binder can be burned in such units. In some areas of the United States, particularly the Southwest, the high cost of fire wood prohibits the regular burning thereof in fireplaces. However, because of the aesthetic appeal of fireplaces, many homes in the Southwest are equipped with either masonry or sheet metal fireplaces equipped with natural gas outlets and asbestos logs. These gas nozzles are connected to gas supply lines in the home which are in turn connected to the gas supply lines of utility companys. The home owner can turn a key operated valve to cause natural gas, i.e., butane or propane, to be discharged from the nozzle within the fireplace and ignited. However, such gas fired fireplaces are not equipped with glass doors. Very litte effective heat is delivered to the room as a vast majority of the heat from the combusted gas flows up the chimney drawing warm room air out of the dwelling with it. Because of this, such gas fired fireplaces are ignited on an infrequent basis, for example during entertaining. The radiant heat of the fire produced in such a gas fired fireplace is typically not very great. It is not economic to burn combustible gas in such fireplaces at their high consumption rates without getting some reasonable return in the form of effective room heating. Therefore, it would be desirable to provide a gas fired heat extractor insert for the cavity of a gas fired fireplace which utilizes the advantages of a glass door closure and a heat exchanger conduit structure to provide effective room heat while still enabling the aesthetic benefits of the fire to be enjoyed. Such a combination insert would preferably have a high heat extraction efficiency, both to maximize room heating during colder climatic conditions, and to minimize fire hazard due to heating of rear and side dwelling walls.

SUMMARY OF THE INVENTION

The present invention provides a combination glass door fireplace closure and heat exchanger which can be inserted into the cavity of a gas fired fireplace to permit more efficient and economical operation thereof, while still enabling the aesthetically appealing flames to be enjoyed. The insert includes a plurality of substantially parallel C-shaped heat exchanger tubes having open lower and upper ends. The tubes are dimensioned to define a return air flow path which extends around a major portion of the fireplace cavity.

The lower and upper ends of the tubes are coupled to a glass door fireplace closure which is adapted for sealing the frontal opening of the fireplace cavity. The lower and upper portions of the closure have a plurality of air inlets and outlets, respectively. The intermediate portion of the closure includes a pair of hingedly mounted glass panels.

A fire manifold couples the lower ends of the tubes to a first inlet on the right side of the lower portion of the closure beneath the glass panels. A fan is mounted in this first manifold for blowing air through the tubes.

A wide, substantially C-shaped heat exchanger duct surrounds the tubes and has an open lower end adjacent the lower ends of the tubes, and an open upper end adjacent the upper ends of the tubes. A plurality of pipes are connected to their one ends to the outlets extending through the fireplace closure along its upper portion. A second manifold couples the upper ends of the tubes and the upper end of the duct to the upper ends of the pipes. The pipes are spaced apart a suitable distance to permit hot exhaust gases to rise upwardly therebetween into the flue of the chimney.

Air is drawn through the duct by convection and thus it acts as a heat exchanger which increases the heat efficiency of the insert. This permits the unit to be installed in sheet metal fireplaces, sometimes known as "zero clearance" fireplaces, which are now popular in homes and condominiums. The duct further reflects heat back onto the heat exchanger tubes, to result in more heat being transferred to the tubes, and thence to the air circulating therethrough.

A nozzle is mounted beneath the tubes and above the duct for discharging a combustible gas from a source connectable thereto. The nozzle, in its simple form, may comprise a gas pipe which extends perpendicular to the heat exchanger tubes. One end of this nozzle pipe may be sealed with a cap and its other end has a coupling for connecting the nozzle pipe to a gas supply pipe extending from the side of the gas fired fireplace. The nozzle pipe may have a plurality of holes drilled in its side wall which face downwardly.

A horizontal tray is mounted beneath the nozzle pipe and rests on top of the duct. A quantity of sand fills the tray and covers the nozzle pipe. Gas discharged from the pipe diffuses through the sand for more even burning when mixed with air drawn through a combustion air inlet in the lower portion of the glass door closure.

BRIEF DESCRIPTION OF THE DRAWINGS

Throughout the figures, like reference numerals refer to like parts unless otherwise indicated.

DESCRIPTION OF THE PREFERRED EMBODIMENT

Figure 1:
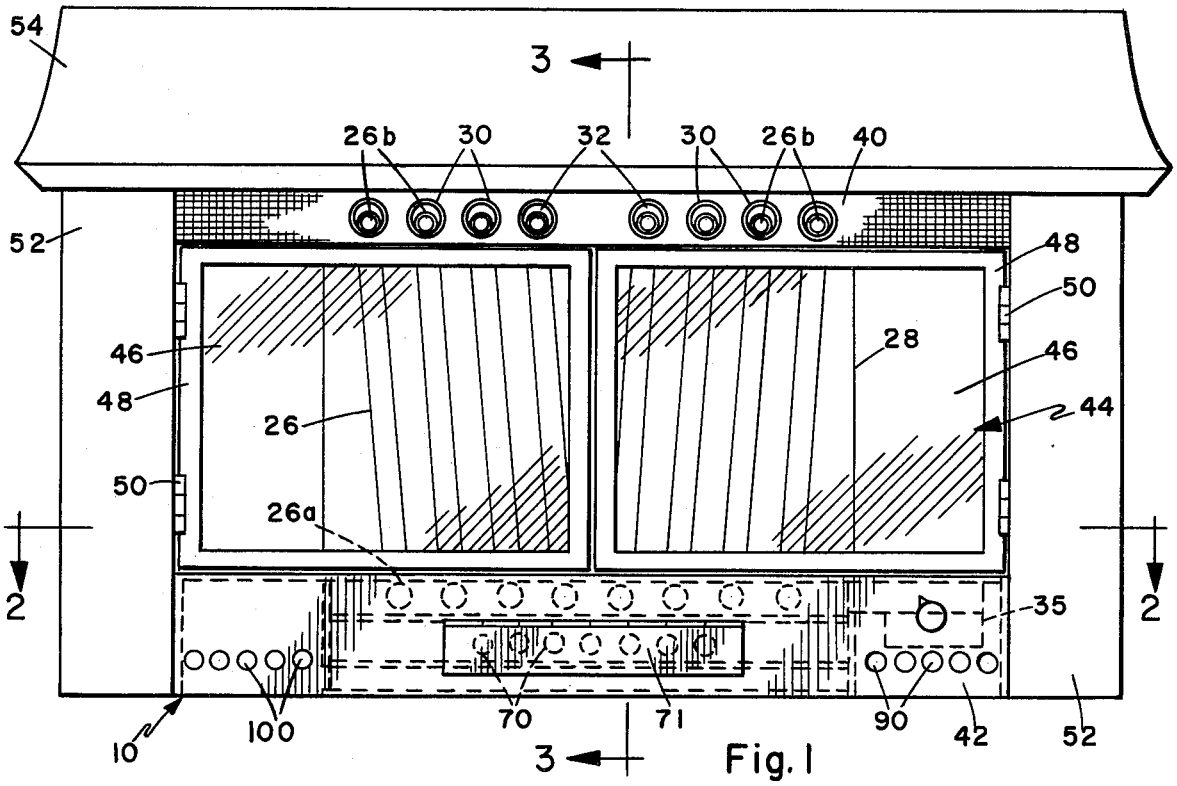
FIG. 1 is a front elevation view of my fireplace insert showing portions of its internal construction in phantom lines.
Figure 2:
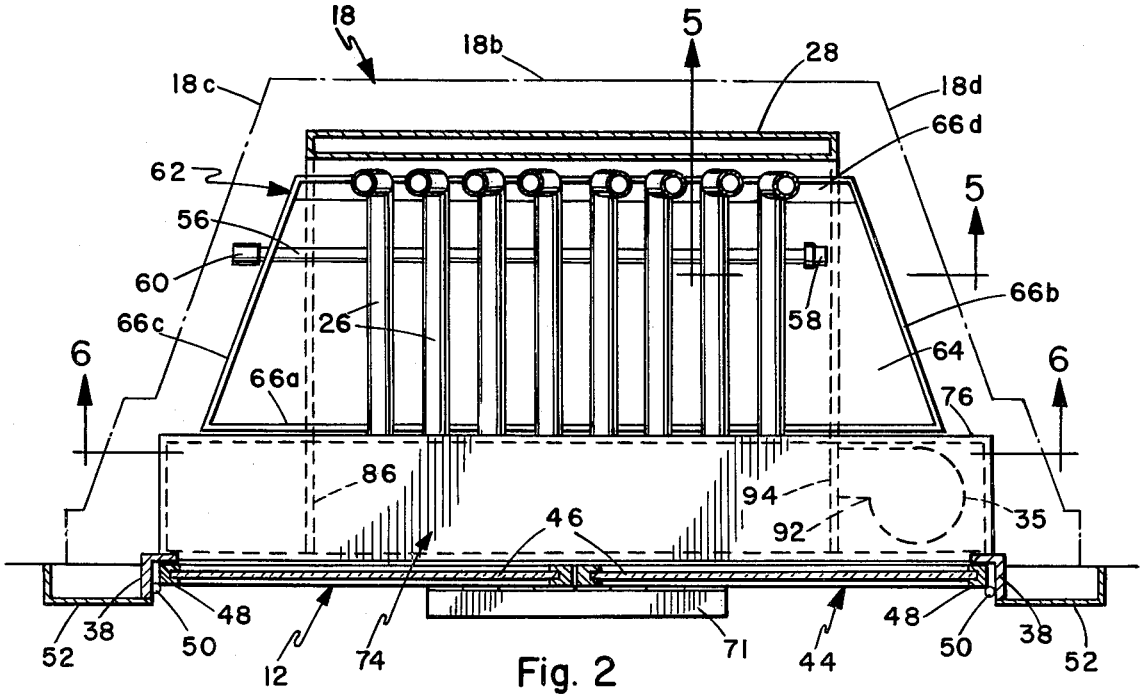
FIG. 2 is a horizontal sectional view of my fireplace taken along line 2—2 of FIG. 1.
Figure 3:
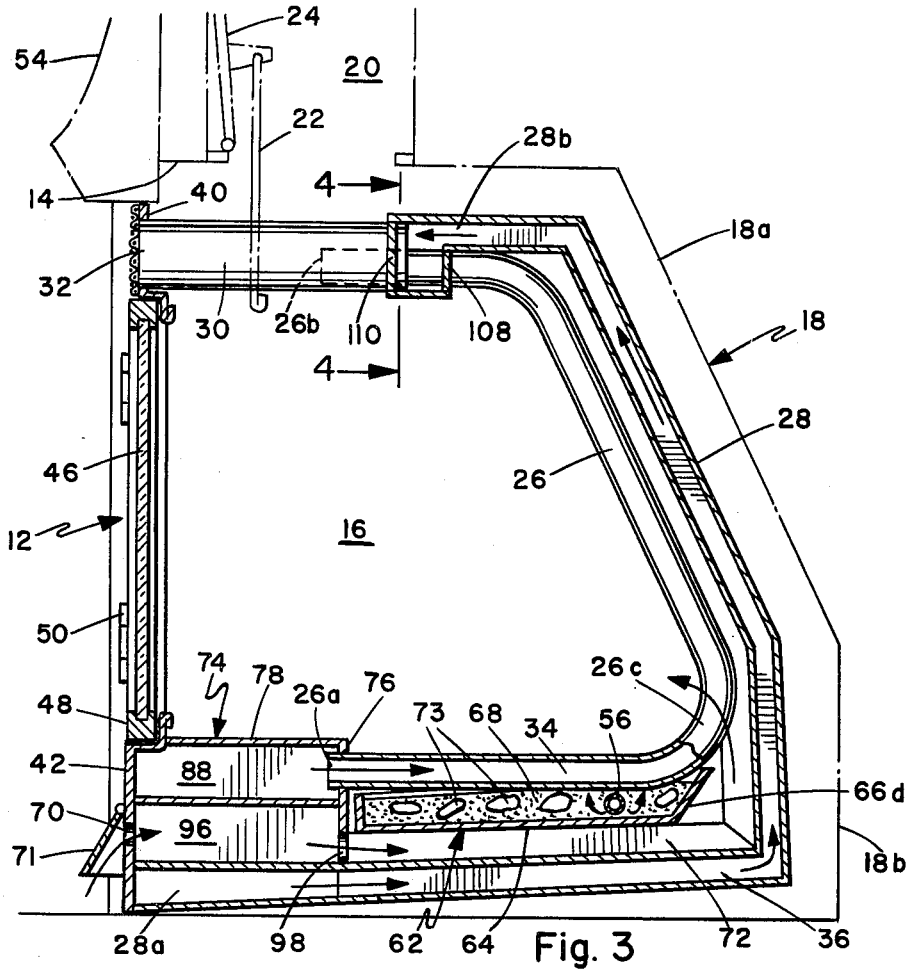
FIG. 3 is an enlarged vertical sectional view of my fireplace insert taken along line 3—3 of FIG. 1.

As shown in FIGS. 1 and 3, the illustrated embodiment of my fireplace insert 10 includes a glass door fireplace closure 12 for sealing the frontal opening 14 of the cavity 16 of a sheet metal or masonry fireplace 18 shown in phantom lines in FIG. 3. The fireplace cavity 16 opens into a flue or chimney 20 (FIG. 3) which can be opened and closed by manually operating a damper control rod 22 to pivot a hingedly mounted damper plate 24 shown in its opened position in FIG. 3. Fireplace 18 has an upwardly and inwardly tapering rear wall section **18*a* and a lower rear wall section 18*b*. As shown in FIG. 2, the vertical sidewalls 18*c* and 18*d* of the fireplace are angled inwardly from the frontal opening 14 of the fireplace so that the fireplace cavity has a trapazoidal configuration in horizontal section. The fireplace insert 10 is conformably shaped as shown in FIGS. 2 and 3 so that it will fit within and occupy a major portion of the fireplace cavity 16**.

The insert 10 includes a plurality of substantially parallel, generally C-shaped heat exchanger tubes 26 (FIGS. 1, 2 and 3) having open lower ends **26*a* and open upper ends 26*b*. As shown in FIG. 1, half of the heat exchanger tubes 26 are slight angled away from the vertical in one direction. The other half of the tubes are slightly angled away an equal amount from the vertical in the other direction. This provides adequate clearance for easy operation of the damper control rod 22. As explained more fully hereafter, manifold means are provided for coupling the lower and upper end of the heat exchanger tubes to respective air inlets and outlets extending through the glass door fireplace closure 12**.

Figure 4:
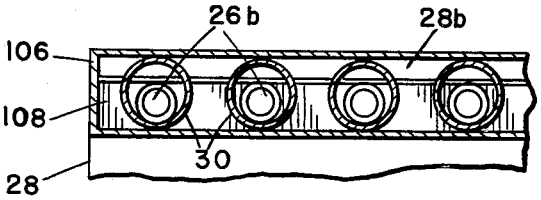
FIG. 4 is an enlarged, framentary vertical sectional view taken along line 4—4 of FIG. 3. This view illustrates the construction of the manifold which couples the upper ends of the heat exchanger tubes and the duct to a plurality of pipes which convey warm air through a plurality of air outlets extending through the fireplace closure.

A substantially C-shaped heat exchanger duct 28 (FIG. 3) surrounds the heat exchanger tubes 26. This heat exchanger duct has an open lower end **28*a* adjacent the lower ends of the heat exchanger tubes 26*a*. The heat exchanger duct further has a open upper end 28*b* adjacent the upper end 26*b* of the heat exchanger tubes (see FIG. 3). As explained more fully hereafter, manifold means are provided for coupling the upper ends of the heat exchanger tubes and the heat exchanger duct to the one ends of a plurality of corresponding vent pipes 30 (FIGS. 3 and 4). These pipes extend horizontally and are fixed in parallel, spaced apart relationship across the upper portion of the fireplace cavity 16 immediately beneath the flue 20. The other ends of the pipes are coupled to a plurality of circular air outlets 32 (FIG. 1) extending through the intermediate part of the upper portion of the glass door fireplace closure 12**.

During operation of the fireplace insert, room air is drawn through the interiors 34 (FIG. 3) of the heat exchanger tubes 26 by a squirrel cage type blower 35 shown in phantom lines in FIG. 2. Heat from fire burning within that portion of the cavity 16 surrounded by the insert is transferred through the heat exchanger tubes 26 to the air flowing therethrough. Warm air from the heat exchanger tubes is expelled through the outlets 32 (FIG. 1) back into the room.

During operation of the insert room air is also drawn by convection through the open lower end 28*a* (FIG. 3) of the heat exchanger duct 28 and through its interior 36 as shown by the arrows in FIG. 3. Heat radiated from the fire burning within the insert is transferred through the walls of the heat exchanger duct to the air flowing therethrough. The air warmed in the heat exchanger duct is expelled therefrom through the open upper end 28*b*, through the vent pipes 30 and through the outlets 32 in the fireplace closure.

The heat exchanger duct 28 has a flat, folded configuration as shown in FIG. 3. Preferably the heat exchanger duct extends substantially across and beyond the width of the plurality of heat exchanger tubes 26 as shown in FIG. 2. The heat exchanger duct forms a secondary or auxillary heat exchanger behind the heat exchanger tubes. It tends to reflect some heat back against the heat exchanger tubes. It also captures some portion of the heat and returns it to the room, which heat would otherwise be absorbed by the rear walls 18*a* and 18*b* of the fireplace. The insert thus includes the combination of a primary heat exchanger in the form of a plurality of tubes 26 immediately adjacent the fireplace fire, and a secondary heat exchanger in the form of a large, folded duct 28 surrounding the tubes and presenting broad surfaces toward the flame. This arrangement increases the efficiency of the insert in terms of extracting heat from the flames in the fireplace and conveying that heat into the room. Less heat is transferred to the walls 18*a*, 18*b*, 18*c* and 18*d* of the fireplace. This provides a decided safety advantage where the insert is utilized in connection with sheet metal or so-called "zero clearance" fireplaces presently utilized in many homes and condominiums. Since heat transfer to the walls of the fireplace is reduced the liklihood of overheating of dwelling walls immediately adjacent to and behind the fireplace is minimized.

The glass door fireplace closure 12 (FIG. 1) includes a rectangular support frame made of a pair of vertical angle iron pieces 38. These pieces are secured at their upper and lower ends to an upper face plate 40 and a lower face plate 42. The heat extractor tubes 26 and the heat exchanger duct 28 are preferably fabricated from stainless steel having a suitable gauge or thickness sufficient to withstand long exposure to high temperatures without deformation or significant oxidation.

The fireplace closure 12 further includes a pair of left and right glass doors 44 (FIGS. 1 and 2). Each of these doors includes a rectangular panel of tempered glass 46 (FIG. 2) supported in a rectangular frame 48. There is adequate clearance between the frame and the glass panel to permit expansion and contraction of the frame without breaking the glass. Each frame is attached with a pair of upper and lower hinges 50 (FIG. 1) to one of the side face panels 52 of the fireplace closure 12. A decorative gable 54 is mounted on top of the upper ends of the side face panels 52 and on top of the upper side edge of the upper face plate 40 (See FIGS. 1 and 3).

Figure 5:
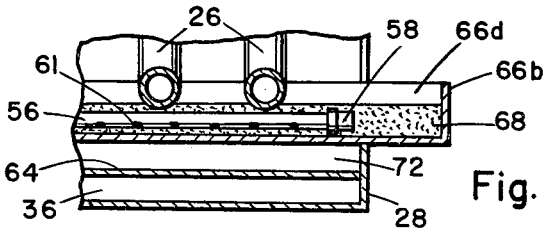
FIG. 5 is an enlarged, framentary vertical sectional view taken along line 5—5 of FIG. 2 illustrating the positioning of the gas nozzle pipe, the tray of sand beneath the heat exchanger pipes, and the duct construction beneath the tray.

The insert is provided with nozzle means 56 (FIGS. 2,3, and 5) mounted beneath the lower legs of the heat exchanger tubes 26 for discharging a combustible gas from a pressurized source connected thereto. Specifically, a lead gas pipe 56 is mounted beneath the heat exchanger tubes adjacent the curved junctions 26*c* (FIG. 3) which connect the bottom leg and the intermediate portion of each of the heat exchanger tubes 26. The gas pipe 56 extends perpendicular to the tubes. One end of the pipe 56 is sealed by a cap 58 (FIG. 5) and the other end of the pipe 56 has a coupling 60 (FIG. 2) for connecting the pipe to the gas supply line (not shown) extending through the side wall of the fireplace. A plurality of holes 61 (FIG. 5) are drilled through the side walls of the gas pipe 56 at longitudinally spaced intervals along the pipe so that combustible gas can be discharged therefrom uniformly across the width of the heat exchanger pipes and the heat exchanger duct. The holes 61 are drilled in the underside of the pipe so that the gas is discharged downwardly and then rises upwardly as indicated by the arrows in FIG. 3.

A horizontally disposed tray 62 (FIGS. 2 and 3) is mounted immediately beneath the heat exchanger pipes and the gas pipe 56. As shown in FIG. 2, the tray has a trapezoidal outline and includes a flat base portion 64 and a plurality of short side walls 66 which extend from the perimeter of the base. The side walls 66*a*, 66*b*, 66*c* extend vertically. The rear side wall 66*d* of the tray 62 slopes rearwardly and upwardly adjacent the curved junction 26*c* of the heat exchanger tubes. The tray 62 is preferably made of stainless steel or galvanized sheet metal.

A quantity of sand 68 (FIG. 3) fills the tray and covers the nozzle means or gas pipe 56. When combustible gas is discharged from the pipe 56 downwardly towards the tray it diffuses within the sand, creating to a limited extent a fluidized bed. When the gas is ignited combustion air is drawn through a plurality of combustion air inlets 70 (FIGS. 1 and 3) formed in the lower face plate 42 as shown by the arrows in FIG. 3. The combustion air is drawn through a combustion air duct 72 (FIG. 3) formed between the heat exchanger duct 28 and the tray 62. The combustion air travels rearwardly through the combustion air duct and enters the portion of the cavity 16 surrounded by the heat exchanger tubes by flowing between the junction portions 26*c* of the tubes. When the combustible gas is ignited the combustion air mixes with the gas and combustion occurs within the bed of sand and above the same. Combustion gases leave the cavity 16 by rising between the vent pipes 30 and rising away from the insert through the flue 20 (FIG. 3).

Preferably a plurality of rocks 73 (FIG. 3) are intermixed with the sand 68 in the tray 62. During combustion the rocks are heated. Residual heat radiated from the rocks 73 strikes the heat exchanger tubes 26. This helps improve the heat exchange efficiency. A decorative hood 71 (FIGS. 2 and 3) is hingedly attached to the lower face plate 42 immediately above the combustion air inlets 70.

Figure 6:
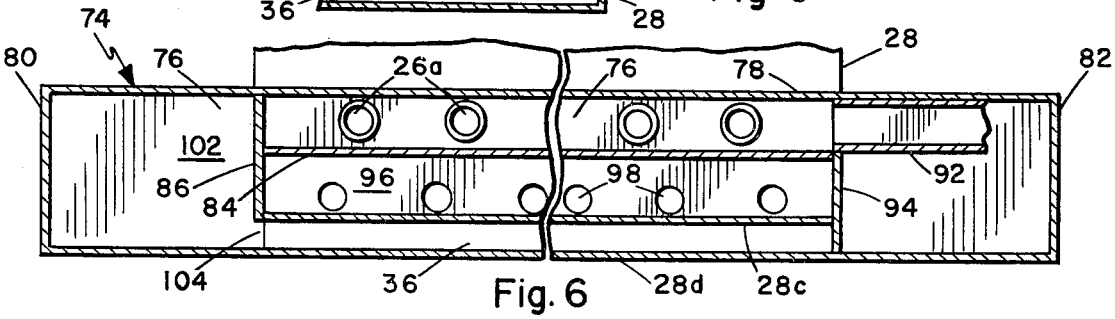
FIG. 6 is an enlarged, framentary vertical sectional view taken along line 6—6 of FIG. 2 illustrating the manifold and duct structure which separately delivers air to the heat exchanger pipes, the heat exchanger duct, and the combustion air duct.

The fireplace insert of the present invention is provided with manifold and conduit means for coupling the lower ends of the heat exchanger tubes 26, the heat exchanger duct 28, and the combustion air duct 72 to three separate sets of sair inlets spaced across the lower portion of the fireplace closure 12. As shown in FIGS. 1, 3 and 6 a box-like duct structure 74 is constructed immediately behind the lower face plate 42 and extends along the length thereof. This duct structure is fabricated from sheet metal which is bent and fastened together by suitable means to direct air as hereafter described. The lower face plate 42 forms one side wall of the duct structure 74. That duct structure further includes a rear wall 76 (FIG. 3), a top wall 78, and a pair of end walls 80 and 82 (See FIG. 6). A horizontally extending divider 84 (FIGS. 3 and 6) and a vertically extending divider 86 define a chamber 88 into which air is blown by the fan 35. The lower open ends 26*a* of the heat exchanger tubes extend through corresponding holes in the rear wall 76 of the duct structure 74 and into the chamber 88. Room air is drawn in through a plurality of air inlets 90 (FIG. 1) in the lower face plate 42 of the glass door closure. The fan 35 expels this air through its outlet conduit 92 (FIG. 6) into the chamber 88. Air within the chamber 88 is distributed among the heat exchanger tubes 26 and flows through the same as indicated by the arrow in FIG. 3.

The upper wall 28*c* of the heat exchanger duct, the vertical divider 86, and a vertical divider 94 define therebetween a second chamber 96 within the box-like duct structure 74. Combustion air is drawn through the plurality of combustion air inlets 70 (FIGS. 1 and 3) into the second chamber 96. This air is drawn by convection through a plurality of spaced apart air inlets 98 (FIGS. 3 and 6) in the rear wall 76 of the duct structure 74 and into the combustion air duct 72.

The bottom wall of the duct structure 74 is formed from the bottom wall 28*d* of the heat exchanger duct (See FIG. 6) which has a substantially larger width in this area than it does rearward of the duct structure 74 (See FIG. 2). Room air is drawn through a plurality of air inlets 100 (FIG. 1) formed in the left side of the lower face plate 42 into a relatively large box-like chamber 102 (FIGS. 2 and 6) formed at the left end of the duct structure 74. This chamber communicates with a side opening 104 (FIG. 6) in the heat exchanger duct 28. Air from the box-like chamber 102 is drawn by convection through the interior 36 of the heat exchanger duct as shown by the arrows in FIG. 3.

Manifold means are also provided for joining the output of the heat exchanger tubes 26 and heat exchanger duct 28 so that they can be expelled through common air outlets 32 (FIG. 1) in the upper face plate 40 of the glass door fireplace closure. As shown in FIG. 3, the upper end of the heat exchanger duct 28 terminates in a box-like structure 106. The upper ends 26*b* of the heat exchanger tubes extend through corresponding holes in the rear wall 108 of the structure 106 as shown in FIGS. 3 and 4. The one ends of the vent pipes 30 extend through corresponding holes in the front wall 110 of the box-like structure 106, there being an equal number of vent pipes and heat exchanger tubes. The vent pipes 30 have an inner diameter which is considerably larger than the outer diameter of the heat exchanger tubes. The vent pipes are aligned with respect to the box-like structure 106 at the upper end of the heat exchanger duct so that the upper ends of the heat exchanger tubes extend into the interior of corresponding ones of the vent pipes as best seen in FIGS. 3 and 4. The other ends of the vent pipes 30 extend through corresponding ones of the air outlet holes 32 (FIG. 1). A decorative screen 112 covers the outlet 32 as shown in FIGS. 1 and 3.

Having described a preferred embodiment of my fireplace insert, it should be apparent to those skilled in the art that the insert permits of modification in both arrangement and detail. Therefore, my invention should be limited only in accordance with the scope of the following claims.

I claim:

1. A gas fired heat extractor insert for the cavity of a fireplace, comprising:

a plurality of substantially parallel C-shaped heat exchanger tubes having open lower and upper ends;

a substantially C-shaped heat exchanger duct surrounding the tubes and having an open lower end adjacent the lower ends of the tubes and an open upper end adjacent the upper ends of the tubes, the duct extending substantially across the width of the tubes;

a glass door fireplace closure for sealing the frontal opening of the cavity and attached to the ends of the tubes and the duct;

first manifold means for coupling the lower ends of the tubes to a first air inlet extending through the fireplace closure;

conduit means for coupling the lower end of the duct to a second air inlet extending through the fireplace closure;

second manifold means for coupling the upper ends of the tubes and the duct to a plurality of air outlets extending through the fireplace closure, including a plurality of outlet pipes extending between the outlets in the fireplace closure and the upper ends of the tubes and the duct, the pipes being spaced apart to permit hot exhaust gases to rise upwardly therebetween into a flue of the fireplace; and nozzle means mounted beneath the tubes and above the duct for discharging a combustible gas from a source connectable thereto so that the gas can be burned with air drawn through a third air inlet extending through the fireplace closure.

2. A gas fired heat extractor insert for the cavity of a fireplace, comprising:

a plurality of substantially parallel C-shaped heat exchanger tubes having open lower and upper ends;

a substantially C-shaped heat exchanger duct surrounding the tubes and having an open lower end adjacent the lower ends of the tubes and an open upper end adjacent the upper ends of the tubes, the duct extending substantially across the width of the tubes;

a glass door fireplace closure for sealing the cavity and attached to the ends of the tubes and the duct;

first manifold means for coupling the lower ends of the tubes to a first air inlet extending through one side of the lower portion of the fireplace closure, including a fan for blowing air through the tubes;

conduit means for coupling the lower end of the duct to a second air inlet extending through the other side of the lower portion of the fireplace closure;

second manifold means for coupling the upper ends of the tubes and the duct to a plurality of air outlets extending through the fireplace closure and spaced across the upper portion thereof, including a plurality of outlet pipes extending between the outlets and the upper ends of the tubes and the ducts, the pipes being spaced apart to permit hot exhaust gases to rise upwardly therebetween into a flue of the fireplace;

third manifold means for coupling the upper ends of the tubes and the duct to the pipes;

nozzle means mounted beneath the tubes and above the duct for discharging a combustible gas from a source connectable thereto so that the gas can be burned with air drawn through a third air inlet extending through the middle of the lower portion of the fireplace closure, the nozzle means including at least one gas pipe extending substantially perpendicular to the tubes, the pipe having a cap sealing its one end, a coupling at its other end for coupling the pipe to a gas supply pipe, and a plurality of longitudinally spaced holes extending through the sidewall of the gas pipe and directed generally downwardly;

a tray mounted beneath the gas pipe of the nozzle means and above the duct; and a quantity of sand filling the tray and covering the gas pipe of the nozzle means for diffusing the combustible gas discharged from the gas pipe.

3. The invention of claim 2 and further comprising a plurality of rocks supported by the tray and intermixed with the sand.

* * * * *